US007181887B1

(12) United States Patent
Baij

(10) Patent No.: US 7,181,887 B1
(45) Date of Patent: Feb. 27, 2007

(54) FRAMING LUMBER PRODUCTS AND METHODS

(76) Inventor: Fred Christian Baij, 861 Cherry Creek Rd., Marquette, MI (US) 49855

( * ) Notice: Subject to any disclaimer, the term of this patent is extended or adjusted under 35 U.S.C. 154(b) by 0 days.

(21) Appl. No.: 09/535,457

(22) Filed: Mar. 24, 2000

(51) Int. Cl.
*E04B 1/00* (2006.01)

(52) U.S. Cl. ..... 52/105; 52/243; 52/481.1

(58) Field of Classification Search ..... 52/243, 52/586.1, 578, 481.1, 241, 238.1, 317, 733.2, 52/733.3, 105; 446/105, 106, 124
See application file for complete search history.

(56) References Cited

U.S. PATENT DOCUMENTS

| | | | | | |
|---|---|---|---|---|---|
| 2,713,203 | A | | 7/1955 | Gottlieb | 33/1 |
| 3,169,320 | A | * | 2/1965 | Currie | 33/429 |
| 3,539,174 | A | | 11/1970 | Borello | 269/319 |
| 4,212,108 | A | * | 7/1980 | Jackson | 33/501 |
| 4,392,204 | A | | 7/1983 | Prim et al. | 364/478 |
| 4,845,858 | A | * | 7/1989 | Thomas | 33/759 |
| 4,942,670 | A | | 7/1990 | Brandt | 33/494 |
| 5,012,590 | A | | 5/1991 | Wagner et al. | 33/759 |
| 5,165,212 | A | * | 11/1992 | Arnold | 52/586 |
| 5,274,973 | A | * | 1/1994 | Liang | 52/243 |
| 5,396,710 | A | * | 3/1995 | Battaglia | 33/429 |
| 5,632,095 | A | | 5/1997 | Day | 33/494 |
| 5,782,054 | A | * | 7/1998 | Varoglu et al. | 52/780 |
| 5,784,850 | A | | 7/1998 | Elderson | 52/667 |
| 6,173,505 | B1 | * | 1/2001 | Munno | 33/761 |
| 6,360,448 | B1 | * | 3/2002 | Smyj | 33/562 |
| 6,775,916 | B2 | * | 8/2004 | Sparkes | 33/613 |

FOREIGN PATENT DOCUMENTS

| | | | |
|---|---|---|---|
| CA | 2369630 | * | 1/2002 |

* cited by examiner

*Primary Examiner*—Naoko Slack
*Assistant Examiner*—Chi Q. Nguyen
(74) *Attorney, Agent, or Firm*—Wilhelm Law Service, S.C.; Thomas D. Wilhelm

(57) ABSTRACT

Lumber having stud locator markings spaced along lengths thereof. The marked lumber assists in layout and assembly of a frame wall comprising bottom plate, top plate, and a plurality of studs extending between the bottom and top plates at one or more of a limited number of regularly-spaced pre-determined stud spacings along the plates. Respective pieces of the lumber are useful in the bottom and/or top plates. Stud locator markings define positions for placement, on the respective plate, of stud ends to be mounted against the respective bottom or top plate. Stud locator markings indicate where front and back surfaces of the studs intersect the respective plate. The stud markings are spaced along the bottom and top plates at one or more of the pre-determined stud spacings. Each stud marking comprises marking material affixed directly to the respective piece of lumber. Preferred spacings for stud markings are about 8 inches, optionally 16 or 24 inches. Variations in spacing between the several stud markings on a piece of lumber, and between respective pieces of lumber, are preferably no more than 0.13 inch. The lumber is preferably substantially devoid of location indicators except for the stud markings. The invention also comprehends methods of fabricating lumber, methods of distributing dimension lumber, and methods of fabricating a wall.

12 Claims, 4 Drawing Sheets

FRAMING LUMBER PRODUCTS AND METHODS

BACKGROUND

This invention relates to the construction industry, and especially to building products and buildings and building elements made with such products, to methods of making building products, and methods of employing building products in the framing of buildings.

This invention relates specifically to products and methods for reducing the cost of building a wall by laying out the bottom plate, the top plate, and the studs, and assembling the studs to the bottom plate and the top plate. The invention relates to methods of making and using such products to build a building.

As used herein, framing refers to an early stage of constructing a building wherein structural members are assembled to make a structural skeleton generally defining outer wall and roof elements as well as interior wall, floor, and ceiling skeletons, which provide structural strength to the building. Thus, framing materials are those structural members which, in certain building designs, provide the structural framework for supporting closing and finishing elements such as wall closure panels, flooring, ceiling, windows, doors, and like building components which typically provide the primary visible members in a finished building.

Building structural members are made from a variety of materials, the most common of which are natural stone, manufactured natural stone products, synthetic stone products, wood, and metal. This invention relates specifically to elongate structural members, typically wood or steel members, which are commonly used to develop such a skeletal framework for supporting the building. Such structural members, when made of wood, are commonly referred to as lumber. Corresponding structural members, made of sheet metal such as steel, are also commonly available. Such structural products can also be made from a variety of other materials, so long as such other materials provide the requisite structural strength. Accordingly, the strength of the respective material for a given cross-sectional area of such a structural member affects specification of thicknesses of elements which are used to make structural member products from that material.

For example, in a wood 2×4 piece of lumber, the full volume defined by the 2×4 thickness and width dimensions is occupied by wood. In a corresponding steel 2×4 piece of lumber, the general perimeter of the lumber as defined by the width and thickness dimensions thereof is sheet steel sufficiently thick to provide the necessary structural strength. The remaining interior portion of the framing member is empty, e.g. occupied by air. Those skilled in the art are familiar with such conventional product cross-sections.

A plurality of elongate wood building material products such as described above are sometimes referred to as framing lumber, also referred to as "sticks" or "boards" of lumber. Units of such framing lumber are commonly assembled together to make the framework or skeletal structure of the building. A typical such framework or skeletal structure for e.g. upstanding walls includes a bottom horizontal member typically referred to as a bottom plate, and a top horizontal member typically referred to as a top plate oriented parallel to and opposite the bottom plate. A plurality of studs span the distance between the bottom plate and the top plate. The studs are typically perpendicular to both the bottom plate and the top plate. The studs are connected to the bottom plate and the top plate, and thus connect the bottom plate and top plate to each other, thereby to define a wall assemblage comprising the bottom plate, the top plate, and the several studs.

A variety of materials, e.g. steel, can be used to make "lumber" products, namely elongate structural members, which can be assembled in respective stud and plate arrangements. Typical dimensions of such structural members often correspond to the dimensions commonly used for wood products which would be used in making respective assemblies for application to such structural skeletons. Namely, for a given structure assembly, e.g. exterior width and thickness of stud and plate are the same irrespective of whether wood or steel is used.

Accordingly, the terms "lumber" and "lumber product" include all wood products, whether using natural wood, or products employing aggregates of wood flakes, wood chips, wood sawdust, and the like, with or without other material additions; as well as products made with other materials, e.g. steel, or other materials in combination with wood, and conventionally used in place of such wood products. Typically, the outer width and thickness dimensions of such products closely resemble the respective outer dimensions of natural wood products, but such dimensions can vary and still be satisfactory. Thus, for example, a manufactured wood I-beam or truss can be used in place of a natural wood joist or rafter.

As used herein, "natural wood" product is a product fabricated by dimensioning and finishing a wood product relying for strength and structural integrity on the wood as harvested from a tree, and not relying primarily on adhesives or the like to hold together a large number of wood elements, or wherein wood elements represent less than, for example, 90 percent by volume of the product.

Certain portions of the construction industry have developed standards for spacings between the studs. While not all buildings are built according to standard stud spacings, use of standard stud spacings is preferred where consistent with the objectives of the construction project and the building. Standard spacing distances can vary e.g. from country to country, depending on historical and cultural patterns in various parts of the world. Whatever standard may be applicable, the use of standards in a given community, state, country, or other sociologically defined population, facilitates design and construction of buildings where the standards can be used without violating the objectives of the building project or applicable law. And indeed, standardized stud spacing at the framing stage of the building project facilitates other steps in the building project.

One of the steps in a conventional process of assembling the wall is to make marks on the bottom plate and the top plate at locations where the studs are to intersect the bottom plate and top plate, and thus the locations where the studs are to be assembled to the bottom plate and top plate.

The accuracy of placement of the studs affects a variety of steps subsequently performed in the process of constructing the building. Because of the importance associated with accuracy of placement of the stud locator markings, the job of placing the stud locator markings on the bottom plate and top plate is commonly assigned to a relatively senior worker such as the crew leader of the framing crew. The stud locator markings, when so marked, indicate the desired locations where the ends of the studs are to be secured to the bottom plate and the top plate.

In conventional practice, the markings are typically drawn free-hand with a carpenter's pencil or other hand-held marker, at the construction site, typically with assist of a tape measure to determine distances. Making the stud locator markings by hand is accompanied by a number of shortcomings. First, doing the work by hand is labor intensive and thus relatively costly.

Second, doing the work by free hand drawing leads to inaccuracies. For example, since sophisticated tools are normally not used, the mark as made may not comply closely with the intended spacing.

Third, the mark may extend across the board at a non-perpendicular angle whereby the stud spacing at one side of the board may be different from the spacing at the other side of the board.

Fourth, any visible impression such as a line not being straight, or not being perpendicular, gives the impression that accuracy or precision is not important, whereby other workers e.g. installing the studs, may be influenced to employ less effort in the precision or accuracy of their work.

Fifth, performing the work at the construction site adds to the on-site construction time.

It is an object of the invention to provide lumber and like framing member products having stud locator markings at desired stud spacings.

It is another object to provide such framing lumber products wherein the markings are applied by machines, not by hand-held markers.

It is yet another object to provide such framing lumber products wherein marking materials are printed or otherwise applied directly to the surface of a substrate member from which the framing lumber products are made.

It is a further object to provide such framing lumber products wherein the markings are formed by cutting, burning, etching, oxidizing, or otherwise modifying the substrate material from which the framing lumber is made.

It is yet another object to provide such framing lumber products wherein variations in the indicated stud spacing are consistently less than 0.13 inch leading edge to leading edge.

It is still another object to provide such framing lumber products wherein the stud locator markings are spaced to accommodate at least two standard stud spacings, while retaining readily distinguishing features in the overall stud markings layout on the respective framing member so as to enable unskilled workers to recognize the desired spacings and lay out the studs between the bottom plate and top plate.

It is yet another object to provide framing lumber products having stud locator markings which include crossing lines which resemble the enlarged "X" markings commonly employed when the markings are conventionally made by hand drawing.

It is another object to provide framing lumber products which are devoid of marking indicators away from the stud locator marking, thereby to enhance viewer-recognition of the stud locator markings.

Still another object is to provide bundles of such framing lumber products bearing the stud locator markings on the individual boards or other units of the framing lumber products.

Other objects are to provide methods of fabricating framing lumber products bearing the stud locator markings, for example at the manufacturing facility where the lumber dimensions are established, at a retail facility, or at another manufacturing facility.

Still other objects are associated with selling units of framing lumber products from a common stock of un-marked units of such product, and applying stud locator markings to respective ones of the un-marked units of lumber product which are to be used as e.g. bottom plate or top plate, after such units have been sold to customers and before such units are delivered to such customers.

Yet other objects are to provide improved methods of constructing walls of buildings including laying out the framing lumber units, in accord with stud locator markings applied to the lumber while the lumber was still off site, and prior to the framing lumber units arriving at the construction site.

SUMMARY OF THE DISCLOSURE

The invention comprehends a bundle of framing lumber product, comprising a plurality of elongate pieces of dimension lumber, and a plurality of stud locator markings spaced along the lengths of the elongate pieces of dimension lumber.

The pieces of dimension lumber are generally useful for laying out and assembling a wall, wherein the wall comprises a bottom plate, a top plate, and a plurality of dimension studs extending between the bottom plate and the top plate at one or more of a limited number of e.g. regularly-spaced pre-determined standard stud spacings along the bottom plate and the top plate. Respective ones of the elongate pieces of lumber are useful in the bottom plate and/or the top plate. The respective elongate pieces of lumber have first and second ends and lengths therebetween, front surfaces and back surfaces, and opposing sides extending between the front and back surfaces along the lengths thereof.

Each stud locator marking defines a position for placement, on the respective elongate piece of lumber, of an end of a stud dimension lumber piece having opposing front and back surfaces and a preferably standard thickness dimension therebetween, against the respective elongate piece of lumber. The respective stud locator markings on the respective elongate pieces of lumber indicate the positions where the front and back surfaces of respective stud lumber pieces are to be placed against the respective elongate piece of e.g. dimension lumber. The stud locator markings are spaced from each other along the lengths of the elongate pieces of lumber at at least one of the limited number of pre-determined standard stud spacings. Each of the plurality of stud locator markings comprises marking material affixed directly to the respective elongate piece of lumber.

The stud locator markings on units of the framing lumber product are preferably spaced at about 8 inches leading edge to leading edge, optionally 16 inches or 24 inches, or any other desired standard stud spacing.

In preferred embodiments, variations in spacing between the stud locator markings on a respective framing lumber product, and between respective ones of the framing lumber products, are consistently no more than 0.13 inch leading edge to leading edge.

Some embodiments include sets of 2 side-by-side stud locator markings arrayed along the lengths of respective units of the framing lumber product.

Respective units of the framing lumber product are preferably substantially devoid of location marking indicators except for the stud locator markings.

In some embodiments, the stud locator markings extend substantially across the full widths of units of the framing lumber product, the units of the framing lumber product being devoid of other marking indicators extending more than half way across the widths of the framing lumber products whereby the stud locator markings can be readily visually distinguished from any such other markings by appearance differences which are not color differences.

Preferred lumber product comprises respective stud locator markings having respective leading edge lines, trailing edge lines, and crossing lines between the leading and trailing edge lines, optionally first and second crossing lines extending from respective leading edge lines to respective trailing edge lines.

In a second family of embodiments, the invention comprehends a framing lumber product useful in laying out and assembling a wall wherein the wall comprises a bottom plate and a top plate, and a plurality of dimension studs extending between the bottom plate and the top plate at one or more of a limited number of pre-determined cooperating, preferably standard stud spacings along the bottom plate and the top plate. The framing lumber product comprises an elongate piece of lumber for use in one of the bottom plate and the top plate, and a plurality of stud locator markings spaced along the length of the elongate piece of lumber. The elongate piece of lumber has first and second ends and a length therebetween, a front surface and a back surface, and opposing sides extending between the front and back surfaces along the length thereof. Each stud locator marking defines a position for placement, on the elongate piece of dimension lumber, of an end of a stud dimension lumber piece having opposing front and back surfaces and a preferably standard thickness dimension therebetween, against the elongate piece of lumber. The marking indicators on the elongate piece of lumber indicate the positions where the front and back surfaces of respective stud lumber pieces are to be placed against the elongate piece of lumber. The stud locator markings are spaced from each other along the length of the elongate piece of lumber at at least one of the limited number of pre-determined standard stud spacings. Each of the plurality of stud locator markings comprises marking material affixed directly to the elongate piece of lumber such that a process of placing a stud against the framing lumber product does not routinely displace the respective stud locator marking.

The framing lumber product may include sets of 2 side-by-side stud locator markings arrayed along the length of the framing lumber product.

In a third family of embodiments, the invention comprehends a framing lumber product operative to assist in layout and assembly of a wall wherein such wall comprises a bottom plate and a top plate, and a plurality of dimension studs extending between the bottom plate and the top plate at one or more of a limited number of pre-determined preferably standard cooperating stud spacings along the bottom plate and the top plate. The framing lumber product comprises an elongate piece of lumber for use in one of the bottom plate and the top plate, and a plurality of stud locator markings spaced along the length of the elongate piece of lumber. The elongate piece of lumber product has first and second ends and a length therebetween, a front surface and a back surface, and opposing sides extending between the front and back surfaces along the length thereof. Each stud locator marking defines a position for placement, on the elongate piece of lumber, of an end of a stud dimension lumber piece having opposing front and back surfaces and a standard thickness dimension therebetween, against the elongate piece of lumber. The plurality of stud locator markings are spaced from each other along the length of the elongate piece of lumber at at least one of the limited number of pre-determined stud spacings. Each of the stud locator markings comprises marking material affixed directly to the elongate piece of lumber such that a process of placing a stud against the framing lumber product does not routinely displace the respective stud locator marking. The elongate piece of lumber is generally devoid of marking indicators away from the stud locator markings.

In a fourth family of embodiments, the invention comprehends a method of fabricating a lumber product. The method comprises fabricating a stick of lumber as to length, width, and thickness at a manufacturing facility; after fabricating the stick of lumber and before delivering the stick to a customer, defining a plurality of stud locator markings on the stick, including arraying the stud locator markings on the stick at intervals of one or more of a limited number of predetermined preferably standard cooperating stud spacings, the spacings of the stud locator markings thus corresponding to standard spacings where front and back surfaces of stud dimension lumber pieces may be placed against the respective stick of dimension lumber in layout and assembly of a wall.

In some embodiments, the method comprehends defining and emplacing the stud locator markings on the stick of lumber prior to shipping the stick from the manufacturing facility.

In some embodiments, the method comprises defining and emplacing the stud locator markings on the stick at the retail distribution facility.

Preferred methods of defining and emplacing the stud markings on the stick include, for example and without limitation, printing the stud locator markings onto the stick of lumber, chemically etching the stud locator markings onto the stick of lumber, making the stud locator markings by oxidizing stick material at a respective surface of the stick, making the stud locator markings by burning respective markings into the surface of the stick with laser-generated energy, or mechanically or otherwise cutting shallow lines in a respective surface of the stick of lumber.

The invention also comprehends a method of distributing lumber having length, width and thickness. The method comprises shipping the lumber from a fabrication facility via a distribution system which delivers the lumber to a sales distribution facility; receiving and temporarily storing the lumber at the sales distribution facility, pending sale of units of the lumber; delivering units of the lumber to customers; and after shipping the lumber from the fabrication facility and before delivering the units of lumber to customers, defining on at least one respective unit of the lumber a plurality of stud locator markings, including arraying the stud locator markings on the unit of the lumber at one or more of a limited number of predetermined preferably cooperating stud spacings. The spacings of the stud locator markings thus correspond to preferably standard spacings where front and back surfaces of stud dimension lumber pieces may be placed against the respective unit of lumber in layout and assembly of a wall.

Some embodiments include stocking the lumber in the sales distribution facility without stud locator markings thereon, selling as a seller, from the unmarked stock respective units for use as marked units and respective units for use as unmarked units, and after selling units to a purchaser, to be used as marked units, marking the respective units at desired stud spacings with stud locator markings before delivering such units to the purchaser, such that the seller provides to purchasers both unmarked and marked units of lumber from a single common stock of units of lumber.

The method may include shipping the lumber from the dimension fabrication facility to a second manufacturing facility and defining the stud locator markings on one or more units of the lumber at the second manufacturing facility before delivering the lumber to the sales distribution facility.

Optionally, the method comprehends defining the stud locator markings on respective units of lumber while the units of lumber are located at the retail distribution facility.

In yet another family of embodiments, the invention comprehends, in the process of building construction, a method of fabricating a wall. The method comprises acquiring first and second units of elongate lumber bearing thereon pre-affixed stud locator markings arrayed along lengths thereof at one of a limited number of predetermined preferably standard cooperating stud spacings; and laying out the first and second units of elongate lumber parallel to and spaced from each other. The first and second units each define a plurality of stud locator markings thereon, arrayed along the length of the respective units of lumber, at one or more of a limited number of predetermined such stud spacings. The spacings of the stud locator markings correspond to spacings where front and back surfaces of stud lumber pieces may intersect the respective unit of lumber in layout and assembly of the wall.

The method further includes aligning the stud locator markings on the first unit of elongate lumber with the stud locator markings on the second unit of elongate lumber, such that a stud extending between respective cooperating stud locator markings on the respective first and second units of elongate lumber is placed against both the first unit and the second unit at respective first and second generally perpendicular angles.

As used herein, the phrase "generally perpendicular" allows for the normal angle variations commonly resulting from construction work done on the building site.

The method yet further includes laying out studs between facing ones of the stud locator markings on the respective first and second units of product thus to define the first unit of product as a bottom plate and the second unit of product as a top plate of the wall to be fabricated, and a plurality of stud members extending between the bottom plate and the top plate; and assembling and securing the studs to the top plate and the bottom plate, the studs thereby defining generally perpendicular angles with the top plate and the bottom plate, thereby to fabricate a wall structural framework combining the studs, the bottom plate, and the top plate without making stud locator markings on the bottom plate and top plate at the construction site.

The method optionally includes, for example, acquiring first and second such units of lumber as 2×4's and assembling thereto 2×4 studs to make a wall structural framework, acquiring first and second such units of lumber as 2×6's and assembling thereto 2×6 studs to make a wall structural framework, or acquiring first and second such units of lumber as 2×8's and assembling thereto 2×8 studs to make a wall structural framework, and the like.

Figure 1:
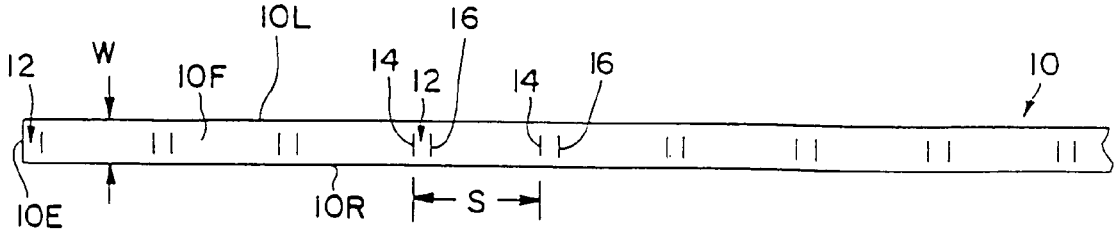
FIG. 1 shows a cut away plan view of a first embodiment of lumber products of the invention showing a simplistic illustration of stud markings of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring to the drawings, FIG. 1 shows a top view of a first embodiment of a unit of framing lumber product 10 of the invention. Such framing lumber product is also referred to, both herein and in the trade, as a "stick" of wood, or as a "board." All such wording is to be taken as referring to the class of framing materials used in fabricating frame wall structures and the like discussed herein, irrespective of the composition of the material associated with such framing lumber product. Thus, e.g. wood and steel products are all generally referred to using a common naming convention.

Figure 5:
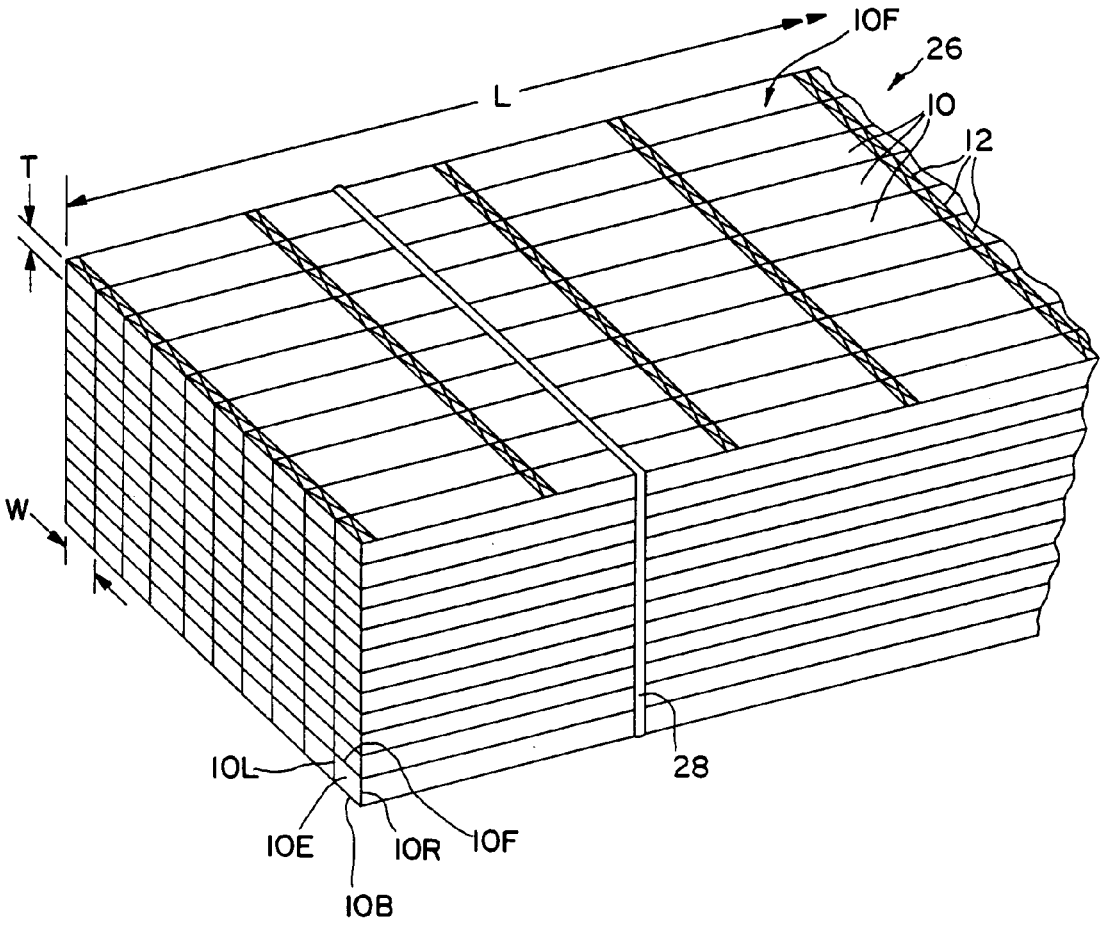
FIG. 5 shows a cut away bundle of sticks of lumber representing a fourth embodiment of lumber products of the invention.
Figure 6:
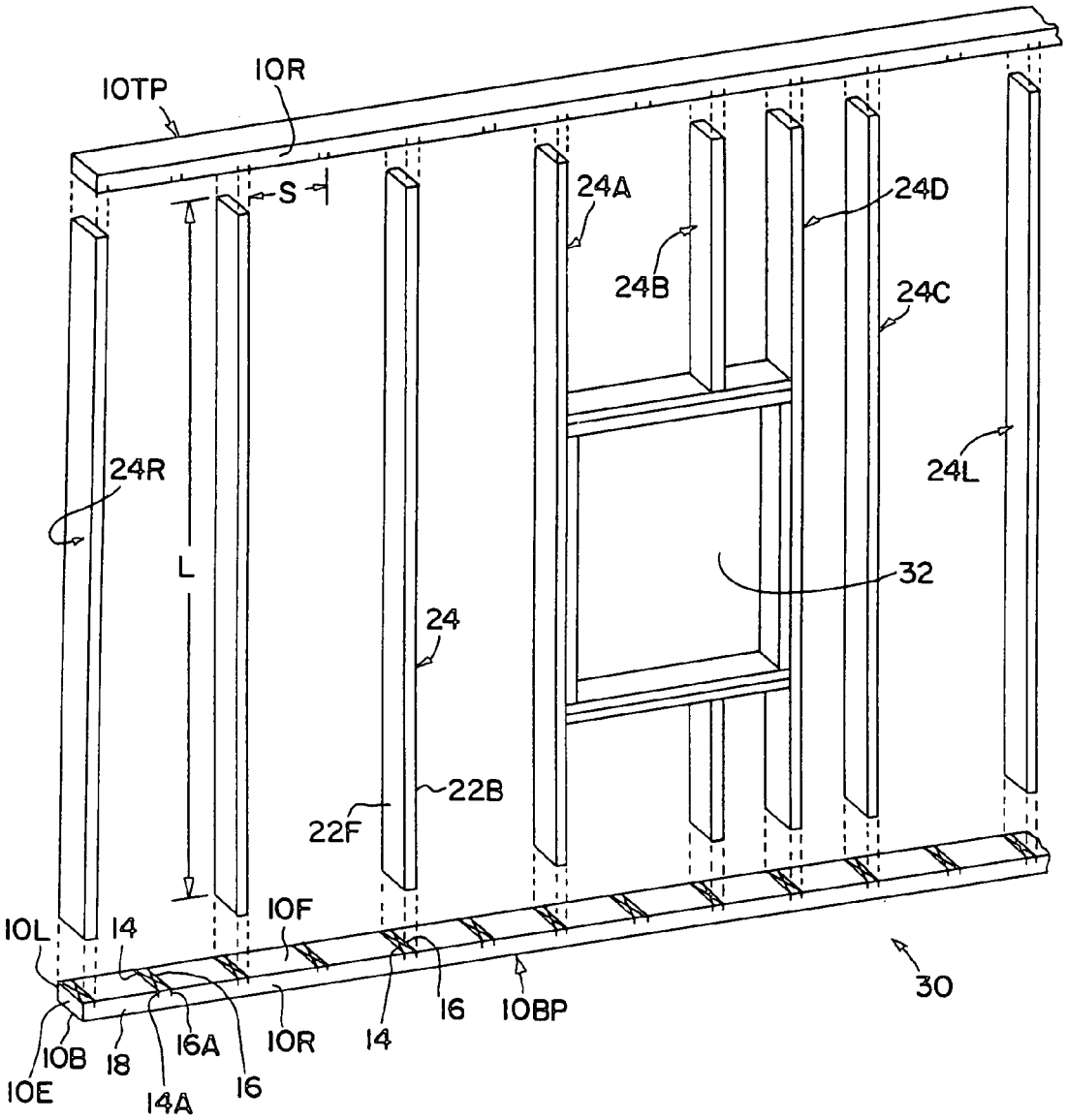
FIG. 6 shows an exploded orthogonal view of a cut away portion of a wall made with sticks of lumber product of an embodiment as in FIG. 2 but without the second trailing mark.

Board 10 has a length "L," a width "W," and a thickness "T," all as illustrated in FIGS. 5 and 6. The width and thickness are preferably, though not necessarily, uniform along length "L." Board 10 is defined by a front surface 10F, a back surface 10B, a left side surface 10L, a right side surface 10R, and end surfaces 10E.

Board 10 bears a plurality of stud locator markings 12 evenly-spaced along the length thereof. Each marking 12 includes a leading mark 14 and a trailing mark 16. Respective leading and trailing marks are omitted when generally coincident with end surfaces 10E. Thus, note the absence of mark 14 at end surface 10E in FIG. 1.

Leading and trailing marks 14, 16 are illustrated in FIG. 1 as lines printed on the substrate wood of board 10. Marks 14, 16 indicate the positions where the ends of front and back surfaces, 22F and 22B respectively, of respective studs 24 (FIG. 6) are to be placed against, or intersect, board 10 when the board is used along with other framing members, in making a wall frame assembly or other suitable building frame assembly.

Marks 14, 16 can be located precisely at the loci where the stud surfaces are to intersect board 10. However, in order to provide for typical variations in thickness of commercially available studs, marks 14, 16 are preferably spaced away from each other by an additional short distance such as about 0.06 inch to about 0.13 inch so that marks 14, 16 are not completely covered when an oversize stud is placed on board 10. It will be understood by those skilled in the art that stud dimensions vary within a normal range in accord with standard cutting and surfacing tolerances, as well as in accord with variations in, and changes in, moisture content of water-containing stud materials such as wood.

As illustrated in FIGS. 1–3 and 5–6, marks 14, 16 should be prominent and readily seen on board 10, so as to facilitate worker recognition of the locations of stud locator markings 12. Thus, marks 14, 16 typically extend across a substantial portion of width "W" on the respective, e.g. top, surface of the board. Marks 14, 16, can optionally extend part or all the way down one or both of side surfaces 10L or 10R, as mark elements 14A, 16A respectively (FIG. 6), whereby the marks 14A, 16A remain visible even if one or both of marks 14, 16 on front or top surface 10F are covered by e.g. an oversize stud.

Marks 14, 16 should be sufficiently distinctive to be readily recognized and distinguished as defining markings 12. Marks 14, 16 may, for example, be relatively dark and/or thick in width, or spaced from other markings, and thereby be visually conspicuous, so as to quickly catch the viewer's eye. Within the context of being readily perceived as the stud markings, markings 12 can take on a variety of forms, can be made a variety of ways, and can employ a variety of marking methods and materials.

Thus, markings 14, 16 can be as simple in configuration as a pair of lines as seen in FIG. 1. The configuration of markings 14, 16 can be represented by an array of more than two e.g. parallel lines (not shown), can be represented by fully covering with marking material the entirety (not shown) of the area defined as the marking 12, or by any other indicator design or graphic, or other single or multiple indicators suitable to associate the respective marks, design, or graphic or other indicator with the area so being defined as marking 12. Thus, what is illustrated as markings 14, 16 is exemplary of a wide variety of single or multiple element indicators and indicator elements that can be used to define markings 12. In light of the teachings here, a wide variety of such indicators and elements can now be devised by mere engineering selection by those skilled in the art.

The illustrated embodiments show a significant advantage of preferred embodiments of the invention. Namely, other than the stud markings, in the illustrated embodiments, the front/top surface of the board is generally devoid of scale or other organized markings other than the stud markings, and is thus not generally suitable as a measuring scale. While the e.g. 8-inch spacing of markings 12 such as in FIGS. 1–3 and 6 does provide for limited measurement capability at 8-inch intervals, no general measurement scaling is indicated on surface 10F. Thus, while markings 12 are spaced apart by known distances, preferred embodiments of boards of the invention are generally devoid of wholesale scale markings sufficient for use as general measuring instrument. The absence of indicator markings other than stud locator markings 12 works to focus the viewer's attention on the stud locator markings, and separately works to avoid creating marking "clutter" which may hide or otherwise obfuscate a worker's perception of the markings 12.

A variety of marking machines, processes, and materials can be used to form marks 14, 16. For example and without limitation, marks 14, 16 can be printed on board 10 using readily available printers and printing inks, can be cut into the wood as with a mechanical saw, or can be chemically etched into the wood. Marks 14, 16 can be burned into the wood using, for example, a laser beam, or can be formed by other forms of oxidizing or otherwise modifying the wood to create the desired visual indications. Similar marking machines and processes can readily be devised for forming marks 14, 16 on units of framing lumber product made from other materials such as e.g. steel.

In all cases, the marking materials used to form stud locator markings 12 are limited in location to the general areas of markings 12 and do not extend generally from marking to marking. Further, the marking materials, e.g. the printing ink, are affixed directly to the underlying substrate of the framing lumber product.

To that end, the underlying substrate is not limited to e.g. the wood, or metal, which provides the bulk of the strength of the lumber product. Thus, the substrate may comprise multiple layers including, for example, coatings, lamina, and the like intended for purposes other than that of providing marking indicators to assist in measuring or cutting of the board, and/or the making of an assembly using the board. For example, the substrate may include one or more layers as a coating or other lamina which forms an intimate component of the underlying substrate material affixed directly or indirectly to an underlying primary e.g. wood or steel strength member, or the substrate may comprise a number of layers which together define the primary substrate strength.

Namely, the marking materials are not, in this invention, affixed to a tape or other carrier layer generally extending along the length of the board including between markings 12, wherein primary purpose of the carrier layer is to serve as carrier of the marking material and to assist in making measurements along the length of the board.

Figure 2:
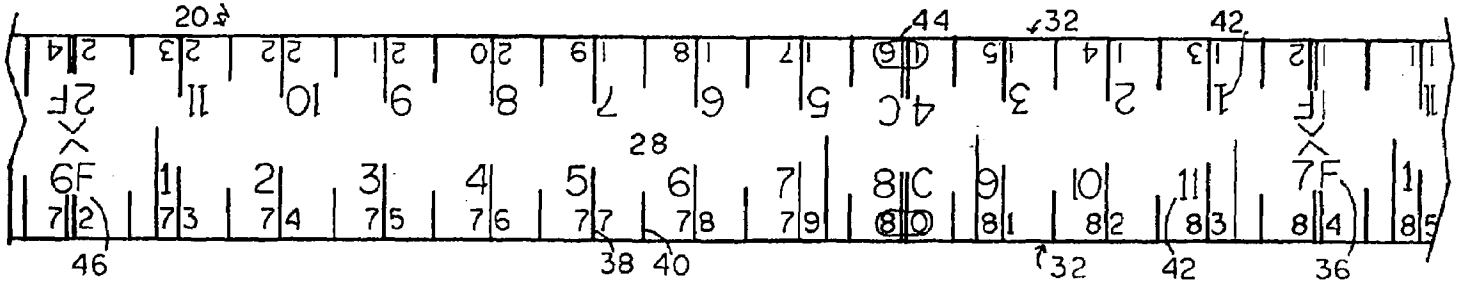
FIG. 2 shows a cut away plan view of a second embodiment of lumber products of the invention employing "X's" in the stud marking indicators, as well as a second trailing mark.

The embodiment of FIG. 2 differs from the embodiment illustrated in FIG. 1 in two ways. First, each of crossing lines 20A and 20B extends from leading mark 14 to trailing mark 16, or could as well be described as extending from trailing mark 16 to leading mark 14. In some embodiments, lines 20A, 20B are confined to the space inside marks 14, 16, so as to not touch marks 14, 16. Some of the crossing lines 20A, 20B are so drawn in FIG. 5. As to each marking 12, crossing lines 20A, 20B thus generally define an "X" inside the respective marking. Crossing lines 20A, 20B preferably do extend the full distance between marks 14, 16, generally as illustrated in FIG. 2 because the industry practice of creating the stud locator markings on bottom plates and boards commonly includes such outlying lines (14, 16) in combination with such crossing lines (20A, 20B) touching such outlying lines, whereby the combination of such crossing lines disposed inside respective leading and trailing lines is familiar to trained workers, and use of such linear configuration in the invention avoids recognition training when the invention is first introduced to a work crew on the construction site.

Second, the embodiment of FIG. 2 differs from the embodiment illustrated in FIG. 1 by adding a second trailing mark 16B, defining between mark 16 and mark 16B, an additional marking 12A immediately adjacent, and contiguous with, marking 12. Marking 12A, for example, sets forth the locus where a second stud may be placed against, and joined to, board 10 in a double-thickness stud arrangement such as around a window or door opening.

In both FIGS. 1 and 2, respective markings 12 are spaced from each other by a distance "S" defined from a first leading mark 14 to a leading mark 14 in an adjacent marking 12. FIGS. 1 and 2 are generally drawn to indicate relative dimensions of a standard 2×4 board, having nominal width "W" of 3.5 inches and nominal thickness "T" of 1.5 inches. According to those approximate size relationships, the distances "S" between markings 12, leading mark line 14 to leading mark line 14, are spaced from each other by 8 inches.

The 8-inch spacing accommodates both the 16-inch stud spacing standard wherein a stud is joined to board 10 at every other marking 12, and the 24-inch stud spacing standard wherein a stud is joined to board 10 at every third marking 12. Namely, the marking spacing can be standardized at 8 inches because both both 16 and 24 are whole number multiples of 8. Accordingly, the 8-inch spacing is preferred whereby, for boards of a given width, thickness, and length, a single product specification can be stocked for sale and use as bottom plate and/or top plate to define either 16 inch or 24 inch spacings.

The markings can be applied to individual units of product when the product is sold to a consumer at e.g. a retail store or lumber yard, and before the product is released to the customer whereby the lumber product is pre-marked when purchased by the consumer. In the alternative, the product can be manufactured, such as at a lumber manufacturing facility, so that most or all of the units of such product in a bin or bundle are pre-marked and thus bear e.g. 8-inch markings when they arrive and are stocked at the retail store or lumber yard. In such case, the seller may elect to fill all sales of boards of such dimensions from the marked stock, or may elect to fill from such marked stock only sales of boards where the customer expects to use the markings to locate or place stud ends or ends of other sticks of framing lumber.

While both 16 and 24 are whole number multiples of 2-inch and 4-inch spacings, 2-inch and 4-inch spacings are so close together as to again present visual clutter on the board. Thus, spacings "S" of 4 inches and less are not part of this invention.

Such pre-marked lumber attracts a premium cost of manufacture because of the cost of pre-marking the lumber pieces at the manufacturing facility. Accordingly, the customer normally prefers the cost advantage of buying the marked lumber only for those framing members where the benefits of the markings are realized, namely where stud spacing determinations are being made.

Spacing "S" can as well be 16 inches, 24 inches, or any other spacing that accommodates the desired standards environment in which the lumber product may be expected to be used without introducing visual clutter that tends to obfuscate the selection of stud markings for stud placement. However, lumber bearing only a 16 inch spacing is not readily used at 24 inch spacing. Similarly, lumber bearing only a 24 inch spacing is not readily used at 16 inch spacing. The critical characteristic of the spacing of markings 12 is that the spacing accommodate at least one spacing standard in the environment within which the board is intended to be used, preferably a spacing standard to the cultural environment within which the board is intended to be used. Accommodating 2 or more spacing standards, or custom spacings, with a single unit of product is preferred. For example, in the United States of America, 16 inch and 24 inch spacings are standard. In countries using the metric system, a metric measure is standard, and so spacing "S" is based on a metric unit of measure in such countries.

Figure 3:
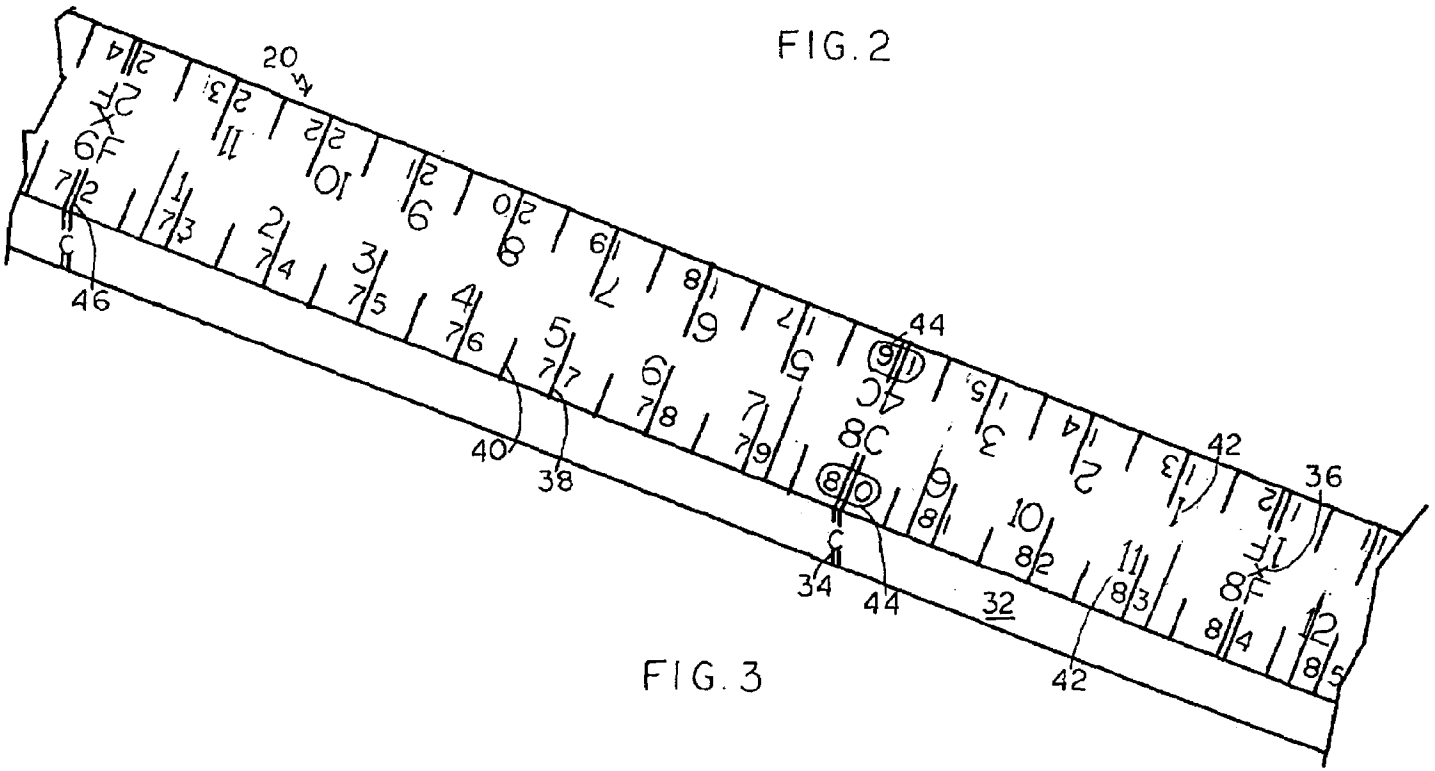
FIG. 3 shows a cut away plan view of a third embodiment of lumber products of the invention employing a center line indicator in the markings.

The embodiment of FIG. 3 differs from the embodiments of FIGS. 1 and 2 in that crossing lines 20A, 20B of FIG. 2 have been deleted and a dashed center line 21 has been added, extending parallel to, and mid-way between marks 14, 16. Dashed center line 21 thus indicates the center of the respective marking 12. Center line 21 may be used, for example, to locate respective back and front stud surfaces 22 when a pair of studs is to be positioned straddling the respective marking. In addition, center line 21 can be used as a cut indicator where the respective plate is to be cut at the mid-point of the marking so as to accommodate a single stud straddling a joint in the respective plate.

Figure 4:
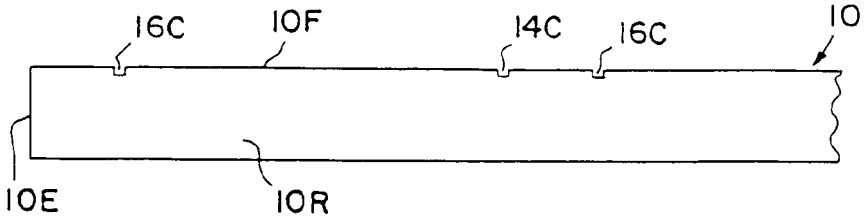
FIG. 4 shows a fragmentary elevation view of a third embodiment of lumber products of the invention.

FIG. 4 shows a side elevation of a short section of a board 10, looking across the top of the board, thus showing an edge view of the front surface 10F of the board. Marks 14 and 16 are shallow mechanical cuts, such as from a saw blade, indicated as 14C and 16C and cut into front surface 10F of the board. Thus, cuts 14C, 16C extend into the board a minor distance e.g. no more that about 10% of thickness "T," preferably no more than 5% of the thickness.

FIG. 5 illustrates a first end of a bundle 26 of boards of the invention. The bundle includes a plurality of boards 10, held together by e.g. straps 28 to form the bundle. A single strap is shown in FIG. 5. Those skilled in the art will recognize the appropriate number and type of straps to be used in a given shipping or other handling environment. The boards 10 illustrated in FIG. 5 are generally dimensioned as 2×4's bearing markings 12 spaced at spacings "S" of 16 inches.

The exploded view of FIG. 6 illustrates use of marked boards 10 in combination with studs 24 to make an upstanding, e.g. vertical, wall frame structure 30. FIG. 6 illustrates the left portion of a wall, cut away at the right side of the drawing. As seen in FIG. 6, a marked horizontal bottom plate board 10BP is located at the bottom of the wall structure. A marked horizontal top plate board 10TP is located at the top of the wall structure. A plurality of studs 24 extend upwardly, e.g. vertically, between the bottom plate board and the top plate board.

While marked boards 10 may be used for studs 24, the markings are typically not needed on the studs, whereby the assembly is generally not aided by markings on the studs. Thus, the cost of any markings on the studs is generally not balanced by value utilized in such studs, whereby the cost of such markings may become a lost cost. Accordingly, unmarked boards are typically preferred for the studs, so as to avoid losing the premium cost associated with the markings.

FIG. 6 illustrates the use of 8-inch spacings "S" on the bottom plate and top plate boards, in combination with standard 16 inch spacings between the studs. The window opening 32 shown in FIG. 6 illustrates a good use of the 8-inch spacing interval. As seen there, window 32 spans a width greater than the 16-inch nominal spacing between adjacent studs 24A, 24B, and less than the 32 inch nominal spacing between studs 24A, 24C. Thus, an additional stud 24D is conveniently employed at the intervening 8-inch spacing thereby to firmly support the right edge of window opening 32 while employing a standard 8-inch spacing adjustment in the framing structure.

The wall structure represented in FIG. 6 may be assembled as follows. Two marked boards 10 to be used as the bottom plate 10BP and top plate 10TP are selected from a stock of two or more units of such marked boards. The two boards 10 are laid out on a generally horizontal surface on the right side surfaces 10R of the boards. The two boards 10 are spaced from each other by a distance modestly greater than the length "L" of the studs to be placed between the bottom plate and top plate.

As so laid out, the boards are oriented such that stud markings 12 on the bottom plate board are facing respective stud markings 12 on the top plate board, and are aligned with such stud markings on the top plate board. Generally, the marking-to-marking alignment between the bottom plate and top plate boards is such that studs extending between corresponding markings on the two boards form generally perpendicular angles with both the bottom plate board and the top plate board. Further, as illustrated at the left edge of wall structure 30 in FIG. 6, the left end 10E of the bottom plate board is aligned with the left end 10E of the top plate board, so the left stud forms approximately perpendicular angles with both the bottom plate board and the top plate board.

With the bottom plate and top plate boards so laid out, studs are placed in generally perpendicular orientations between the bottom plate and top plate boards at the specified preferably standard intervals. Additional stub studs, such as stud 24B, are added, and regularly-spaced studs may be cut, as needed to provide space and support for openings in the wall, such as openings for windows and doors. The exemplary window opening 32 is illustrated in FIG. 6.

The various wall elements are thus generally placed in the locations where they will be positioned in the assembled wall frame structure 30. The various wall frame structure elements are then fastened, mounted, affixed, or otherwise joined or secured to each other at the indicated stud locator markings by, for example, nails, adhesive, screws, or other fastening technology.

If desired, various ones of the wall structure elements can be secured/affixed to each other before all of the wall elements are positioned as described above. Thus, for example, left and right studs 24L, 24R may be assembled to bottom plate and top plate boards 10BP, 10TP; whereafter the workers select additional studs from stud stock, insert the additional studs into the gross opening defined by the perimeter outlined by bottom plate 10BP, top plate 10TP, stud 24L, and stud 24R, and fasten such studs to the bottom plate and top plate. Once the studs are secured in place, and any auxiliary framing such as around window opening 32 has been completed, the so-fabricated frame wall can be erected into its place in forming part of the skeleton of the building.

The above process generally tracks conventional procedure for assembling a wall, except for the use of the pre-marked boards 10TP and 10BP. Namely, in conventional wall assembly, unmarked bottom plate and top plate boards are laid out close to each other, optionally in side surface to side surface contact with each other, and are marked with the stud locator markings by a member of the construction crew, at the construction site, before spacing the bottom plate and top plate boards from each other for entry of the stud boards into the frame matrix.

By contrast, in the invention, the steps of positioning the boards for cooperative marking of the boards, and on-site marking of the boards by the construction crew, are omitted.

Regarding conventional framing, there are certain inconsistencies of marking location, inherent in markings drawn free-hand using e.g. a carpenter's pencil. The placement of the markings on the boards in a typically more closely controlled manufacturing environment, as in the invention, provides added precision and repeatability to the location of the markings so placed, whereby greater conformity and precision in stud spacings, and greater conformity and precision to the desired perpendicularity of the angles between the studs and the bottom plate and top plate, may be achieved in the finished frame wall structure.

In some wall embodiments, as in a gable structure, the bottom plate and top plate boards diverge from each other. In such case, the studs may intersect and join e.g. the underlying bottom plate at perpendicular angles, may be spaced at the bottom plate according to the markings 12, and extend from the bottom plate parallel to each other, while the same studs intersect and join e.g. the overlying top plate at non-perpendicular angles and at spacings on the top plate not corresponding to the markings 12 on the top plate board. The lack of correspondence between stud spacing at the top plate and marking spacing on the top plate corresponds to the distance defined by the hypotenuse of a right triangle represented by angle formed by the top plate and bottom plate boards.

The teaching herein has been directed to framing upstanding walls. The invention can be satisfactorily employed for walls oriented at any angle, such as vertical walls, non-vertical but otherwise upstanding walls, and nominally horizontal frameworks such as floors and ceilings, and the like. Thus, the invention contemplates frame assemblies as described here irrespective of the spacial orientation of the so-assembled framing. "Spacial orientation" refers to partially-imaginary surfaces defined by the left and right surfaces 10L, 10R of the respective pieces of lumber.

The primary purpose of indicator markings on framing lumber product of the invention is to define locations for placement of the studs at the bottom plate and top plate, or similar framing members. Any other marking indicators present on the stick, where used, are fabricated to be less distinctive than the stud locator markings so that the stud locator markings are relatively more distinctive and/or more conspicuous, thereby to stand out from any such secondary markings. Thus, while other markings can in some embodiments be employed in combination with the invention, use of such or similar other indicator markings is limited to those which can be employed without detracting from the facile recognition of the stud locator markings.

By so prioritizing the relative importance and distinctiveness of the stud locator markings 12, one can control any tendency for the stud locator markings to recede in distinctness in a "busy" surface, whereby one can control the potential for loss of value of the stud locator markings as an assembly assist. Thus, preferred embodiments are those such as at FIGS. 1, 4, and 5 where the "stud" marked surface 10F is otherwise generally devoid of any other indicator markings, whether locator markings or measurement markings.

As illustrated in FIG. 1, the stud locator markings can extend substantially less than the full width of the respective stick of lumber, especially where the stick is otherwise devoid of other marking indicators.

While not preferred, the invention can be practiced using multiple colors to represent different indicator uses. Thus, a first color (e.g. black) can be used to define the stud locator markings while a second color (e.g. blue) can be used to define inch ruler (not shown) or other markings. However, such use of multiple colors adds to the cost of marking the lumber, whereby, where multiple marking indicators are used, marking indicators readily distinguishable by configuration and/or placement of the marking, are preferred over marking indicators distinguishable by color.

Marking materials used for making the marks such as at 14 and 16 are preferably placed directly on the elongate board 10. Certain marking materials such as inks comprise combinations of ingredients such as colorants, dryers, and e.g. polymeric carriers, and the like used to affix the marking material to a board 10 substrate, wherein such ingredients are desirable elements of the marking material per se. The marking material is distinguished herein from e.g. backing materials used primarily as carriers for the marking material, for example a continuous web of tape onto which the marking material may be printed for subsequent application of the printed tape e.g. along the full length of the bottom plate or top plate board to so mark the respective board.

The teaching herein discusses locations of the front and back surfaces 22F and 22B of the studs. It will be understood by those skilled in the art that dimension lumber pieces vary in width and thickness within industry standards, and such variations are intended to be incorporated into the teaching herein such that the markings for the locations of the stud sides allow for such standard variations.

Positions of the sides of the studs to be joined to the elongate piece of lumber can be indicated on the bottom plate/top plate pieces by e.g. printing on the bottom plate and top plate pieces lines corresponding to the desired locations of the studs. At the end of the elongate bottom plate or top plate piece, the location for the respective side of the stud to be joined to, or otherwise placed against, the elongate bottom plate or top plate piece can be indicated by the end of the respective board 10, as illustrated in FIG. 1.

As used herein, references to "framing lumber product" and to "studs" includes elongate wood building framing materials, commonly referred to as "sticks" of wood, having such standard sizes as 2×4, 2×6, 2×8, 2×10, and the like, and available in a variety of lengths. In addition, "framing lumber product" includes such products made from a variety of other substances, for example, chip board, flake board, sheet metal, various other manufactures made from wood products or fibrous wood by-products such as fiberboard, or combinations of fiberboard with other wood elements, or wood elements with fiberboard or other suitable structural members, as well as laminates and other combinations of such and similar products otherwise known for use as structural framing members. The usefulness of employing the invention in the full range of materials suitable for making structural building or wall framing structures will now be obvious to those skilled in the art.

The marking material has been described herein as being limited to the general areas of the marking such as, for example, by printing with ink as the marking material at the locations indicated by lines 14, 16, 20A, 20B, and the like. It will be understood that the objectives of recognizing proper stud location can as well be met by reversing the image such that the marking material (e.g. ink) is printed everywhere on the associated surface except at the respective lines, or each line can be outlined or otherwise specifically defined by the marking material.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

What is claimed is:

1. A bundle of pre-marked framing lumber product, comprising:

(a) a plurality of pre-marked elongate pieces of lumber operative to assist in layout and assembly of a wall, wherein such wall comprises a bottom plate and a top plate, and a plurality of dimension studs extending between the bottom plate and the top plate at one or more of a limited number of pre-determined stud spacings along the bottom plate and the top plate, wherein respective ones of pre-marked said elongate pieces of lumber are operative for use in the bottom plate and/or the top plate, each said respective pre-marked elongate piece of lumber having a first end and a second end, and a length therebetween, a front surface (10F) and a back surface (10B), opposing sides (10L, 10R) extending between the front and back surfaces along the length thereof, and a thickness dimensions between the front surface (10F) and the back surface (10B), and between opposing sides thereof;

(b) a plurality of stud locator markings (12), reflecting application of the markings by at least one of a marking machine or a lumber-modifying process, not by a hand-held marker, the stud locator markings being spaced from each other along the lengths of said pre-marked elongate pieces of lumber, and disposed directly on the front surfaces (10F) of said pre-marked pieces of lumber, each said stud locator marking having a leading edge and a trailing edge, and defining a position for placement, on the respective front surface (10F), of an end of a stud dimension lumber piece having opposing front (22F) and back (22B) stud surfaces which face along the length of said pre-marked elongate piece of lumber, and a thickness dimension therebetween, to be joined to the respective said pre-marked elongate piece of lumber, the respective said stud locator markings on the front surface (10F) of said pre-marked elongate piece of lumber indicating where the front (22F) and back (22B) surfaces of respective stud lumber pieces are to intersect the respective front surface (10F) of said pre-marked elongate piece of lumber; and (c) at least one strap (18) securing said plurality of pre-marked elongate pieces of lumber together as said bundle, the stud locator markings (12) on a respective said pre-marked elongate piece of lumber being spaced from each other along the length of said pre-marked elongate piece of lumber by at least one of the limited number of pre-determined stud spacings, respective said stud locator markings comprising a leading edge and a trailing edge, wherein the leading edge and the trailing edge are displaced from each other by approximately a standard thickness of such stud lumber piece, said stud locator markings being visually conspicuous on the front surface (10F) of said pre-marked elongate piece of lumber so as to quickly catch the viewer's eye.

2. A bundle of pre-marked framing lumber product as in claim 1, said stud locator markings being spaced at about 8 inches leading edge-to-leading edge.

3. A bundle of pre-marked framing lumber product as in claim 1, said stud locator markings being spaced at about 16 inches leading edge-to-leading edge.

4. A bundle of pre-marked framing lumber product as in claim 1, said stud locator markings being spaced at about 24 inches leading edge-to-leading edge.

5. A bundle of pre-marked framing lumber product as in claim 1, variations in spacing between said stud locator markings on a respective said pre-marked framing lumber product, and from unit of product to unit of product, being consistently no more than 0.13 inch leading edge to leading edge.

6. A bundle of pre-marked framing lumber product as in claim 1, including sets of 2 side-by-side stud locator marks (14, 16) arrayed along the lengths of respective units of said pre-marked framing lumber product.

7. A bundle of pre-marked framing lumber product as in claim 1, respective units of said pre-marked framing lumber product being substantially devoid of any location marking indicators away from the stud locator markings.

8. A bundle of pre-marked framing lumber product as in claim 2, respective units of said pre-marked framing lumber product being substantially devoid of any location marking indicators away from the stud locator markings.

9. A bundle of pre-marked framing lumber product as in claim 1, said stud locator markings extending substantially across the full widths of units of said pre-marked framing lumber product, said units of said framing lumber product being devoid of other marking indicators extending more than half way across the widths of the pre-marked framing lumber products.

10. A bundle of pre-marked framing lumber product as in claim 1, respective said stud locator markings having respective leading edge lines and trailing edge lines.

11. A bundle of pre-marked framing lumber product as in claim 1, a respective said stud locator marking having a leading edge line, a trailing edge line, and crossing lines extending between the leading edge line and the trailing edge line.

12. A bundle of pre-marked framing lumber product as in claim 1 wherein, in a respective said stud locator marking (12), the leading and trailing edges of said marking are spaced from each other by a distance, greater than such pre-determined thickness, by up to about 0.13 inch.

* * * * *